US007887728B2

(12) United States Patent
Takatani et al.

(10) Patent No.: US 7,887,728 B2
(45) Date of Patent: Feb. 15, 2011

(54) SPINNING PACK FOR DRY-WET SPINNING, DIVERTING GUIDE FOR FIBER BUNDLE, AND APPARATUS AND METHOD FOR PRODUCING FIBER BUNDLE

(75) Inventors: Kohei Takatani, Matsuyama (JP); Makoto Kibayashi, Iyo-gun (JP); Koji Matsumoto, Iyo-gun (JP); Kazuhisa Narusawa, Matsuyama (JP)

(73) Assignee: Toray Industries, Inc., Tokyo (JP)

( * ) Notice: Subject to any disclaimer, the term of this patent is extended or adjusted under 35 U.S.C. 154(b) by 483 days.

(21) Appl. No.: 11/630,731

(22) PCT Filed: Jun. 23, 2005

(86) PCT No.: PCT/JP2005/011506

§ 371 (c)(1),
(2), (4) Date: Dec. 21, 2006

(87) PCT Pub. No.: WO2006/001324

PCT Pub. Date: Jan. 5, 2006

(65) Prior Publication Data

US 2008/0290551 A1 Nov. 27, 2008

(30) Foreign Application Priority Data

Jun. 25, 2004 (JP) ..... 2004-187198
Apr. 14, 2005 (JP) ..... 2005-116537

(51) Int. Cl.

| | |
|---|---|
| ***B31C 1/00*** | (2006.01) |
| ***B65H 81/00*** | (2006.01) |
| ***B29C 49/00*** | (2006.01) |
| ***B32B 5/00*** | (2006.01) |
| ***B32B 29/02*** | (2006.01) |
| ***B28B 5/00*** | (2006.01) |

(52) U.S. Cl. ..... 264/184; 264/198; 264/178 R; 425/71; 425/72.1; 425/72.2

(58) Field of Classification Search ..... 264/164, 264/198, 178 R; 425/71, 72.1, 72.2
See application file for complete search history.

(56) References Cited

U.S. PATENT DOCUMENTS 3,384,944 A * 5/1968 Medeiros et al. ..... 425/66

(Continued)

FOREIGN PATENT DOCUMENTS

EP 0 728 854 8/1996

(Continued)

OTHER PUBLICATIONS

International Search Report dated Sep. 27, 2005, application No. PCT/JP2005/011506.

(Continued)

*Primary Examiner*—Khanh Nguyen
*Assistant Examiner*—Matthew Hoover
(74) *Attorney, Agent, or Firm*—RatnerPrestia

(57) ABSTRACT

A spinning pack for dry-wet spinning is provided with a spinneret having not less than 6,000 spinning holes and having an aspect ratio Ra of not less than 2.5 for a spinning hole array of the spinning holes. In a device and method for producing a fiber bundle, a drawing angle of single fibers formed by the single fibers and a spinneret surface of a spinneret is in a range from 87° to 92°, the single fibers being fibers discharged from the outermost spinning holes located in the long side direction of the spinneret and running to a fiber bundle diverting guide provided in a coagulation bath.

19 Claims, 9 Drawing Sheets

U.S. PATENT DOCUMENTS

| | | | | | |
|---|---|---|---|---|---|
| 3,767,756 | A | * | 10/1973 | Blades et al. | 264/184 |
| 3,952,081 | A | * | 4/1976 | Epstein et al. | 264/207 |
| 4,261,943 | A | * | 4/1981 | McCorsley, III | 264/136 |
| 4,414,276 | A | * | 11/1983 | Kiriyama et al. | 428/374 |
| 5,051,159 | A | * | 9/1991 | Togashi et al. | 204/165 |
| 5,169,584 | A | * | 12/1992 | Ross et al. | 264/211.11 |
| 5,624,561 | A | * | 4/1997 | Uenishi et al. | 210/500.32 |
| 6,241,927 | B1 | * | 6/2001 | Mulleder et al. | 264/187 |
| 6,284,174 | B1 | * | 9/2001 | Ueda et al. | 264/104 |

FOREIGN PATENT DOCUMENTS

| | | | |
|---|---|---|---|
| FR | 1 102 056 | | 10/1955 |
| GB | 2 301 309 | | 12/1996 |
| JP | 59-021709 | | 2/1984 |
| JP | 60-094617 | | 5/1985 |
| JP | 11-350244 | A | 12/1999 |
| JP | 11-350245 | | 12/1999 |
| JP | 2000-178824 | A | 6/2000 |
| JP | 2001-348722 | A | 12/2001 |
| WO | WO 98/58103 | | 12/1998 |

OTHER PUBLICATIONS

European Office Action for Application No. EP 05 753 472.9 mailed on Feb. 25, 2009.

* cited by examiner

SPINNING PACK FOR DRY-WET SPINNING, DIVERTING GUIDE FOR FIBER BUNDLE, AND APPARATUS AND METHOD FOR PRODUCING FIBER BUNDLE

This is a U.S. National Phase application of application number PCT/JP2005/011506, filed Jun. 23, 2005.

TECHNICAL FIELD

The present invention relates to a spinning pack for semi-wet (dry-wet) spinning, a fiber bundle diverting guide, and an apparatus and method for producing a fiber bundle. In more detail, the invention relates to a spinning pack for semi-wet spinning having 6,000 or more spinning holes for discharging a raw spinning solution, a fiber bundle diverting guide for changing the running direction of the fiber bundle spun from the spinning pack and running in a coagulating bath, and an apparatus and method for producing a fiber bundle using the spinning pack and the guide.

BACKGROUND ART

A semi-wet spinning method comprises the steps of once discharging a polymer solution (raw spinning solution) from spinning holes of a spinneret into a gas phase portion (usually air), to form fibers, introducing the fibers into a coagulating bath, for coagulating them, and taking up coagulated fibers from the coagulating bath, to form a fiber bundle. In the semi-wet spinning method, since a draft of fibers caused when the fibers are taken up occurs mainly in the gas phase portion, the fibers can be coagulated and gelled at a low tension in the coagulating bath. Based on the process, a fiber bundle having an excellent ability in stretching in a subsequent step can be obtained. The semi-wet spinning method can provide a fiber bundle comprising filaments each of which has a high density.

On the other hand, there is a demand for reducing the production cost of a carbon fiber bundle. One of the methods for responding to the demand is to enhance the productivity of an acrylic fiber bundle necessary for the production of a carbon fiber bundle. For this productivity enhancement, it is necessary to obtain an acrylic fiber bundle by spinning at a higher speed and at a high density (by increasing the number of spinning holes of a spinneret).

However, in the case of spinning at a higher speed, since a running speed of a fiber bundle through a coagulating bath is higher, the amount of coagulating liquid flowing to accompany the running fiber bundle increases. Since the accompanying flow increases, the amount of the coagulating liquid flowing in the coagulating bath increases to swell the liquid surface of the coagulating liquid, causing a phenomenon of vortex formation as the case may be. If this phenomenon occurs, the position of the liquid surface of the coagulating liquid directly under the spinneret varies greatly. This liquid surface variation of the coagulating liquid brings disturbance of an arrangement of the filaments in the fiber bundle and breakage of the filament. If the liquid surface variation of the coagulating liquid is significant, the surface of the spinneret in which the spinning holes are arranged (spinneret surface) contacts the coagulating liquid partially or wholly and it can happen that the semi-wet spinning cannot be performed.

In the case of spinning at a higher density, namely, in the case where the number of spinning holes of the spinneret is increased, if the intervals between the adjacent spinning holes are narrowed, such a phenomenon can happen that while the fibers formed by the spinning holes once pass through the gas phase portion, that is, before they are coagulated, the adjacent filaments adhere to each other. If the number of holes is increased without causing the phenomenon, the intervals between the adjacent spinning holes must be widened. In this case, the spinneret becomes very large and heavy.

The outer circumferential form of the surface of the conventional spinneret (spinneret surface), in which holes are arranged, is generally circular. If the diameter of the circular spinneret is enlarged to increase the number of holes, such a phenomenon occurs that the distance between the spinneret surface and the liquid surface of the coagulating liquid (air gap) at a position near the center of the spinneret surface becomes greatly different from that at a position near the outer circumference of the spinneret surface when the spun numerous filaments are taken up as a fiber bundle. In this case, as in the aforesaid case of spinning at a higher speed, the arrangement of filaments in the fiber bundle is disturbed, and the filament is broken. Further, the spinneret surface may partially or wholly contact the coagulating liquid, and it can happen that semi-wet spinning cannot be performed.

As methods for solving these problems, flow bath spinning apparatuses are proposed (for example, patent documents 1 and 2). A flow bath spinning apparatus refers to a spinning apparatus in which while a raw spinning solution is discharged from spinning holes into a coagulating liquid of a coagulating bath, the coagulating liquid is made to flow together with the formed fibers, and a fiber bundle consisting of the coagulated numerous filaments and the coagulating liquid are made to flow through a pipe (flow pipe portion). In the flow bath spinning apparatus, the accompanying resistance of the coagulating liquid acting on the filaments constituting the fiber bundle owing to the difference between the moving velocity of the fiber bundle and the moving velocity of the coagulating liquid can be reduced. Further, if the flow of the coagulating liquid is forcibly controlled, the rubbing between filaments can be inhibited. If these actions are used, a spinneret larger in the number of spinning holes per spinneret (spindle) can be used, and the running velocity of the fiber bundle can be increased.

However, such a flow bath spinning apparatus has a problem that when the fiber bundle begins to be passed through the flow pipe portion, that is, when the fiber bundle is passed as a yarn, it can happen that the fiber bundle as a lump clogs the spinning hole portion, to disturb the stable spinning state.

On the other hand, it is proposed to float balls on the liquid surface of a coagulating liquid under near a spinneret, for inhibiting the waving of the liquid surface of the coagulating liquid (patent document 3).

However, it is necessary to check the distance between the spinneret surface and the liquid surface of the coagulating liquid for daily production control, and in this case, the balls disturb the work. Therefore, the balls must be removed and the efficiency of control work declines.

Moreover, if a spinneret is enlarged to increase the number of spinning holes of the spinneret, the amount of a raw spinning solution discharged from the spinning holes positioned near the outer circumference of the spinneret surface is likely to be different from that discharged from the spinning holes positioned near the center of the spinneret surface. This difference makes the filaments of the obtained fiber bundle different from each other in fineness. This fineness irregularity lowers the quality of the obtained fiber bundle. Further, this fineness irregularity causes the filaments obtained from the spinning holes positioned near the outer circumference of the spinneret surface to be often broken, to lower the yarn formability of the spinning apparatus.

Various techniques have been studied for increasing the number of holes of a spinneret for a semi-wet spinning method, but the research for increasing the number of holes of the spinneret for the semi-wet spinning method does not show any significant progress.

Patent document 1: JP 03-070006 B

Patent document 2: JP 60-094617 A

Patent document 3: JP 11-350245 A

DISCLOSURE OF THE INVENTION

Problems to be Solved by the invention

The invention has been made for the purpose of solving the problems of the background art as described above.

The object of the invention is to provide a spinning technique that allows the distance between the spinneret surface and the liquid surface of the coagulating liquid, i.e., the air gap at near the center of the spinneret to be kept almost equal to that at near the outer circumference of the spinneret during spinning.

According to the invention, in a continuous spinning for a long time, it can be prevented that a spinneret surface is immersed in a coagulating liquid.

According to the invention, it can be prevented that the amount of a raw spinning solution discharged from spinning holes positioned near the center of a spinneret surface becomes different from that discharged from the spinning holes positioned near the outer circumference of the spinneret surface. Further, it can be prevented that filaments discharged from the spinning holes positioned near the outer circumference of the spinneret surface are broken. As a result, the fiber bundle produced has little or substantially no fineness irregularity among the filaments of the fiber bundle and little or substantially no fuzz.

Means for Solving the Problems

A spinning pack for semi-wet spinning of the invention, which comprises a spinneret housing, a raw spinning solution passage formed inside the spinneret housing, a raw spinning solution feed port formed in the spinneret housing, for feeding the raw spinning solution into the raw spinning solution passage, and a spinneret installed in the spinneret housing and having numerous spinning holes arranged at intervals for discharging the raw spinning solution of the raw spinning solution passage, wherein the outer surface of the spinneret faces the liquid surface of a coagulating liquid through a gas phase, characterized in that the number of the spinning holes is 6,000 or more and that the aspect ratio Ra of an array of the spinning holes is 2.5 or more.

In the spinning pack for semi-wet spinning of the invention, it is preferred that the interval of the adjacent spinning holes is 1 to 3 mm.

In the spinning pack for semi-wet spinning of the invention, it is preferred that a branch plate for branching flow of the raw spinning solution is installed in the raw spinning solution feed passage in the spinneret housing.

In the spinning pack for semi-wet spinning of the invention, it is preferred that a perforated plate for dispersing flow of the raw spinning solution is installed in the raw spinning solution feed passage in the spinneret housing, and that the gap between the perforated plate and the spinneret is 1 to 5 mm.

In the spinning pack for semi-wet spinning of the invention, it is preferred that the numerous spinning holes are classified into at least two spinning hole groups on a surface of the spinneret, and a spinning hole-free zone free from spinning holes is provided between the spinning hole groups.

In the spinning pack for semi-wet spinning of the invention, it is preferred that the width of the spinning hole-free zone is 2.5 to 8 mm.

In the spinning pack for semi-wet spinning of the invention, it is preferred that the flatness of a surface of the spinneret is 0.02 mm or less.

An apparatus for producing a fiber bundle of the invention, which comprises a spinning pack for semi-wet spinning, a coagulating bath tank positioned below the spinning pack with a gap formed between them, and a diverting guide installed in the coagulating bath tank, for changing the running direction of the fiber bundle immersed and running in a coagulating liquid accommodated in the coagulating bath tank, characterized in that the spinning pack for semi-wet spinning is a spinning pack for semi-wet spinning of the invention as set forth in any one of the above constitutions.

In the apparatus for producing a fiber bundle of the invention, it is preferred that the long side direction of the spinneret corresponding to the width direction of the aspect ratio Ra is parallel to the axial direction of the diverting guide, and that the following relation is satisfied:

$$0.5 \leqq \text{Width of the fiber bundle on the diverting guide} / \text{Length of the long sides of the spinneret} \leqq 1.0$$

In the apparatus for producing a fiber bundle of the invention, it is preferred that the diverting guide has a curve having a radius of curvature of 1,000 to 3,000 mm in the major portion in the longitudinal direction thereof, and is rotatably supported in the coagulating bath tank.

In the apparatus for producing a fiber bundle of the invention, it is preferred that a surface of the diverting guide is a satin finished surface having a grain size of 5 to 50 μm.

In the apparatus for producing a fiber bundle of the invention, it is preferred that an observation hole is provided in the coagulating bath tank, for allowing observation of the inside of the tank from outside the tank.

In the apparatus for producing a fiber bundle of the invention, it is preferred that the fiber bundle is a precursor fiber bundle used for producing carbon fibers.

A method for producing a fiber bundle of the invention, in which a fiber bundle is produced using an apparatus for producing a fiber bundle, composed of a spinning pack for semi-wet spinning, a coagulating bath tank positioned below the spinning pack with a gap formed between them, and a diverting guide installed in the coagulating bath tank, for changing the running direction of the fiber bundle immersed and running in a coagulating liquid accommodated in the coagulating bath tank, is characterized in that the spinning pack for semi-wet spinning is a spinning pack for semi-wet spinning of the invention as set forth in any one of the above constitutions, and that the take-up angle of the fibers discharged from the outermost spinning holes formed nearest to the outer circumference of the spinneret and running toward the diverting guide, relative to the spinneret surface of the spinneret is 83° to 92°.

In the method for producing a fiber bundle of the invention, it is preferred that the take-up angle of the fibers discharged from the outermost spinning holes in the long side direction of the spinneret corresponding to the width direction of the aspect ratio Ra and running toward the diverting guide, relative to the spinneret surface of the spinneret is 87° to 92°, and that the take-up angle of the fibers discharged from the outermost spinning holes in the short side direction of the spinneret corresponding to the length direction of the aspect ratio Ra and running toward the diverting guide, relative to the spinneret surface of the spinneret is 83° to 87°.

In the method for producing a fiber bundle of the invention, it is preferred that the diverting guide has a curve having a radius of curvature of 1,000 to 3,000 mm in the major portion in the longitudinal direction thereof, and is rotatably supported in the coagulating bath tank.

In the method for producing a fiber bundle of the invention, it is preferred that a surface of the diverting guide is a satin finished surface having a grain size of 5 to 50 μm.

In the method for producing a fiber bundle of the invention, it is preferred that the long side direction of the spinneret corresponding to the width direction of the aspect ratio Ra is parallel to the axial direction of the diverting guide, and that the following relation is satisfied:

$$0.5 \leqq \text{Width of the fiber bundle on the diverting guide} / \text{Length of the long sides of the spinneret} \leqq 1.0$$

In the method for producing a fiber bundle of the invention, it is preferred that an observation hole is provided in the coagulating bath tank, for allowing observation of the inside of the tank from outside the tank.

In the method for producing a fiber bundle of the invention, it is preferred that the fiber bundle is a precursor fiber bundle used for producing carbon fibers.

A fiber bundle diverting guide of the invention for changing the running direction of the fiber bundle, is used in a coagulating bath tank of a semi-wet spinning apparatus, characterized in that it has a curve having a radius of curvature of 1,000 to 3,000 mm in the major portion in the longitudinal direction thereof, and can be rotated around the axis thereof.

In the fiber bundle diverting guide of the invention, it is preferred that a surface of the diverting guide is a satin finished surface having a grain size of 5 to 50 μm.

The aspect ratio Ra of the spinning hole array in the invention is defined as follows.

First Definition of Aspect Ratio Ra of the Spinning Hole Array:

In a spinneret having numerous spinning holes arranged at positions symmetrically about a first straight line and a second straight line perpendicular to each other, among the straight line distances between respective two spinning holes passed by a straight line parallel to the first straight line among the spinning holes, the longest straight line distance is expressed as A1, and among the straight line distances between respective two spinning holes passed by a straight line parallel to the second straight line among the spinning holes, the longest straight line distance is expressed as B1. In this case, the aspect ratio Ra of the spinning hole array is defined by formula Ra=A1/B1. The direction of the first straight line corresponds to the long side direction of the spinneret, and the direction of the second straight line corresponds to the short side direction of the spinneret.

Second Definition of Aspect Ratio Ra of the Spinning Hole Array:

The face surrounded by the envelope drawn by connecting the spinning holes located on the outermost side of the spinning hole array among the numerous spinning holes arranged in the spinneret surface, is called a spinning hole region. In this case, among the line segments obtained when the straight lines passing the center of the spinneret surface cross the spinning hole region, the length of the shortest line segment is expressed as B2, and among the line segments obtained when the straight lines perpendicular to the shortest line segment cross the spinning hole region, the length of the longest line segment is expressed as A2. In this case, the aspect ratio Ra of the spinning hole array is defined by formula Ra=A2/B2. Meanwhile, the direction of the longest line segment corresponds to the long side direction of the spinneret, and the direction of the shortest line segment corresponds to the short side direction of the spinneret.

As described above, the aspect ratio Ra of the spinning hole array of the invention can be defined by two methods. However, since the spinneret has 6,000 or more spinning holes, there is no substantial difference between the value of aspect ratio Ra based on the first definition and the value of aspect ratio Ra based on the second definition, in the working effects of the invention. Therefore, as required, the definition allowing easier measurement can be used.

Effects of the Invention

According to the invention, in the semi-wet spinning using a spinneret having 6,000 or more spinning holes, the respective spun filaments constituting a fiber bundle are unlikely to be affected by flow of a coagulating liquid flowing to accompany the running of the fiber bundle in a coagulating bath. Therefore, the fiber bundle produced has little or virtually no fineness irregularity between the filaments formed by the spinning holes positioned near the center of the spinneret surface and the filaments formed by the spinning holes positioned near the outer circumference of the spinneret surface. The fiber bundle produced has few or virtually no filament broken therein.

The fiber bundle can be preferably used as a precursor fiber bundle for production of carbon fibers. A carbon fiber bundle produced from the precursor fiber bundle contributes to the cost reduction in the production of a carbon fiber bundle, since the number of carbon filaments is large.

The carbon fiber bundle can be used for producing golf shafts, fishing rods and rackets of tennis, badminton, etc. in sports application. It can be used for producing primary structural materials such as the main wings and floor beams of aircraft in aerospace application. It can be used for producing motor vehicles, windmill blades, pressure vessels, etc. in general industrial application.

MEANINGS OF SYMBOLS

Figure 1:
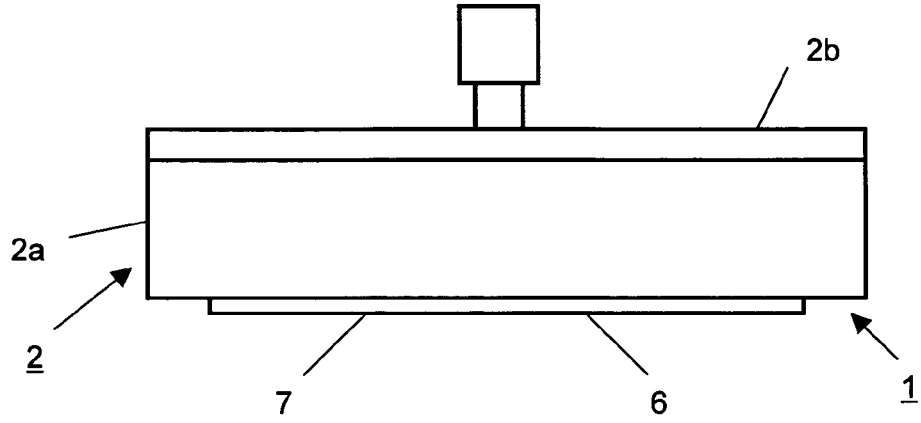
FIG. 1 is a front view showing an example of the spinning pack for semi-wet spinning of the invention.
Figure 2:
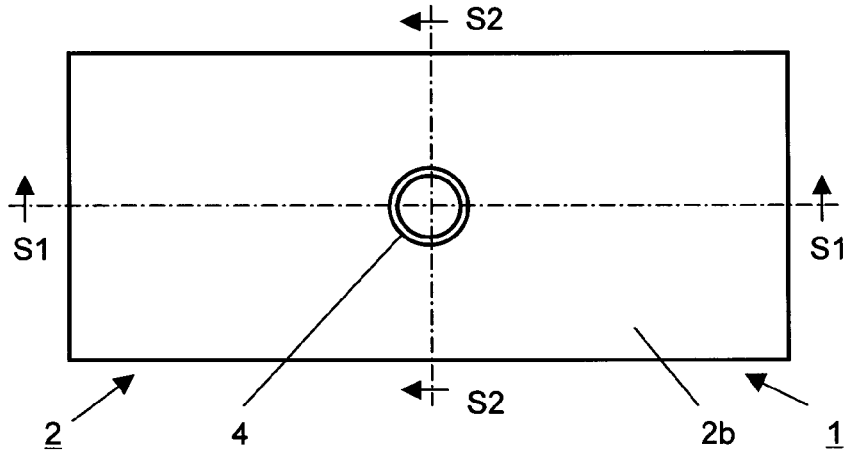
FIG. 2 is a top view showing the spinning pack of FIG. 1.

1: spinning pack for semi-wet spinning
2: spinneret housing
2*a*: lower union
2*b*: upper union
3: raw spinning solution passage
4: raw spinning solution feed port
5: spinning hole
5*a*: spinning hole
5LEa, 5LEb: outermost spinning hole on a long side of spinneret
5SEa, 5SEb: outermost spinning hole on a short side of spinneret
6: spinneret
6*a*: spinneret
6EL: long side of spinneret
6SE: short side of spinneret
6*a*LE: long side of spinneret
6*a*SE: short side of spinneret
7: spinneret surface
8: branch plate
8*a*: branch plate
9: filter
10: perforated plate
10*a*: perforated plate
50: outer circumferential form of spinneret
50*a*: envelope
51*a*, 51*b*, 51*c*: spinning hole group
52: spinning hole region
52*a*, 52*b*, 52*c*: sectional spinning hole region
53*a*, 53*b*: spinning hole-free zone
70: outer circumferential form of spinneret
70*a*: envelope
70Ca, 70Cb: curve
70La, 70Lb: line segment
71*a*, 71*b*: spinning hole group
72: spinning hole region
72*a*, 72*b*: sectional spinning hole region
91: spinning hole body
92: funnel portion
111*a*, 111*b*: branch passage
112*a*, 112*b*: upstream hollow portion
113*a*, 113*b*: branch hole
114*a*, 114*b*: downstream hollow portion
141: flow-through hole
161: coagulating bath tank
162: coagulating liquid
163: coagulating bath
164: liquid surface of coagulating liquid
165: gas phase portion
166: fiber bundle
167: fiber bundle diverting guide
167*a*: fiber bundle diverting guide
168: observation hole
201*a*, 201*b*: bearing
202: surface of diverting guide
θ, θa, θb: take-up angle of filaments

THE BEST MODES FOR CARRYING OUT THE INVENTION

FIGS. 1 to 4 show an example of the spinning pack for semi-wet spinning of the invention.

In FIGS. 1 to 4, a spinning pack 1 for semi-wet spinning comprises a spinneret housing 2, a raw spinning solution passage 3 formed in the spinneret housing 2, a raw spinning solution feed port 4 for feeding the raw spinning solution to the raw spinning solution passage 3, and a spinneret 6 installed in the spinneret housing 2 and having numerous spinning holes 5 arranged at intervals for discharging the raw spinning solution fed from the raw spinning solution passage 3. The bottom surface of the spinneret 6, i.e., a spinneret surface 7 faces the liquid surface of a coagulating liquid in a coagulating bath tank through a gas phase (usually air).

The number of the spinning holes 5 arranged in the spinneret 6 in the spinning pack 1 for semi-wet spinning is 6,000 or more. The aspect ratio Ra of the spinning hole array of the numerous spinning holes 5 is 2.5 or more.

In the embodiment shown in FIGS. 1 to 4, the spinneret housing 2 comprises a lower union 2*a* having open portions in the top face and in the bottom face, an upper union 2*b* mounted in the open portion of the top face of the lower union 2*a*, and the spinneret 6 mounted in the open portion of the bottom face of the lower union 2*a*. The upper union 2*b* has the raw spinning liquid feed port 4.

Figure 5:
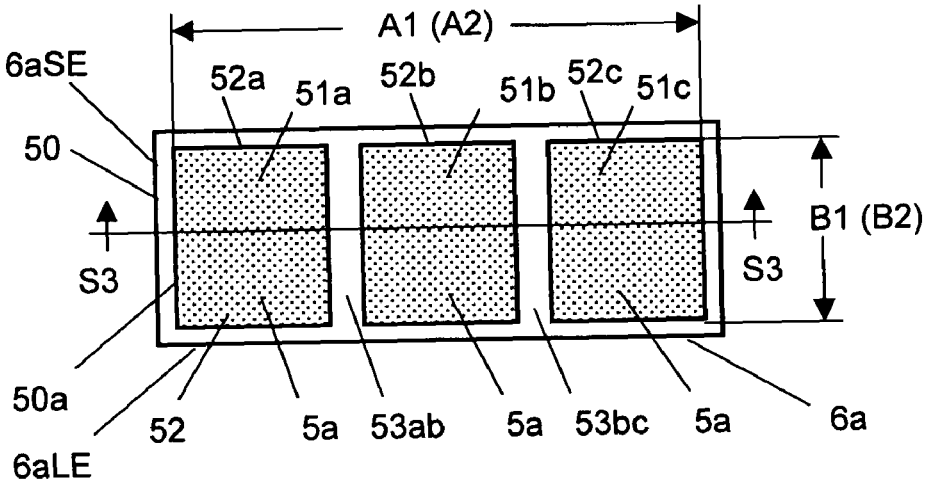
FIG. 5 is a bottom view showing an example of the spinneret used in the spinning pack of FIG. 1.
Figure 6:
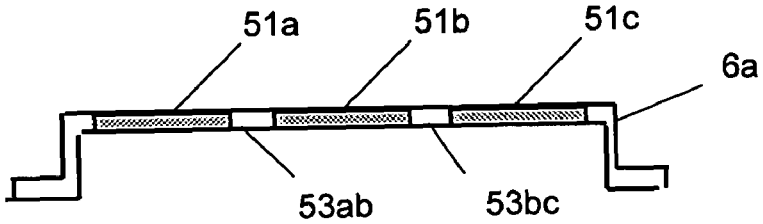
FIG. 6 is an S3-S3 arrow sectional view of FIG. 5.

FIGS. 5 and 6 show an example of the spinneret 6 in the spinning pack 1 for semi-wet spinning shown in FIGS. 1 to 4.

In FIG. 5, the spinneret 6*a* has a rectangular outer circumferential form 50. In the spinneret 6*a*, spinning holes 5*a* as many as 6,000 or more in total are arranged. In the spinneret 6*a*, the numerous spinning holes 5*a* are classified into three spinning hole groups 51*a*, 51*b* and 51*c*. These spinning hole groups 51*a*, 51*b* and 51*c* form sectional spinning hole regions 52*a*, 52*b* and 52*c*. Between the spinning hole group 52*a* and the spinning hole group 52*b*, there is a spinning hole-free zone 53*ab* free from spinning holes, and between the spinning hole group 52*b* and the spinning hole group 52*c*, there is also a spinning hole-free zone 53*bc* free from spinning holes.

The envelope 50*a* drawn by connecting the spinning holes positioned in the outermost side in the array of all the spinning holes 5*a* formed in the spinneret 6*a* forms a rectangle with the directions of the long sides 6*a*LE of the spinneret 6*a* as the long sides and with the directions of the short sides 6*a*SE of the spinneret 6*a* as the short sides. The rectangle drawn by the envelope 50*a* is similar to the outer circumferential form 50 of the spinneret 6*a*. The spinning hole region 52 of the spinneret 6*a* is formed by the face surrounded by the envelope 50*a*.

In FIG. 5, the straight line distance A1 referred to in the first definition of the aspect ratio Ra of the spinning hole array in the spinneret 6*a* is indicated by symbol A1, and the straight line distance B1 is indicated by symbol B1. Further, the length A2 of the longest line segment referred to in the second definition of the aspect ratio Ra of the spinning hole array is indicated by symbol A2, and the length B2 of the shortest line segment is indicated by symbol B2. The numerous spinning holes 5*a* in the spinneret 6*a* are arranged to ensure that the aspect ratio Ra of the spinning hole array becomes 2.5 or more.

Figure 7:
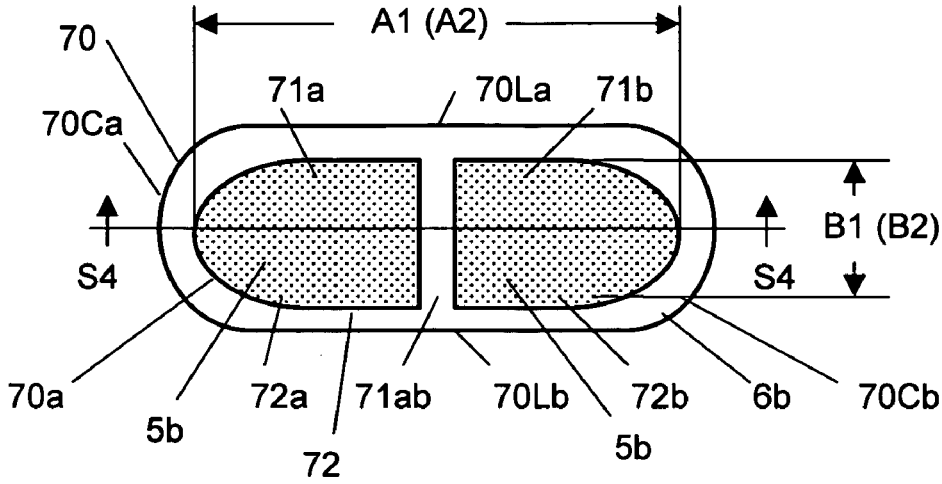
FIG. 7 is a bottom view showing another example of the spinneret used in the spinning pack of FIG. 1.
Figure 8:
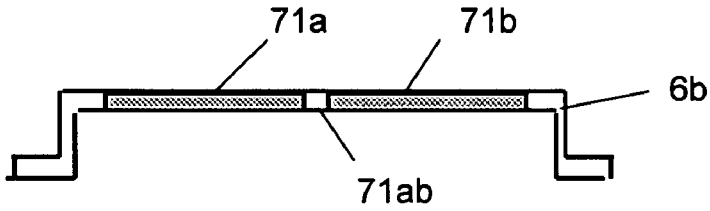
FIG. 8 is an S4-S4 arrow sectional view of FIG. 7.

FIGS. 7 and 8 show another example of the spinneret 6 in the spinning pack 1 for semi-wet spinning shown in FIGS. 1 to 4.

In FIG. 7, the spinneret 6*b* has an outer circumferential form 70 consisting of two top and bottom line segments 70La and 70Lb parallel to each other, and curves 70Ca and 70Cb connected with the ends of these line segments 70La and 70Lb and curved outward. It is preferred that the curves 70Ca and 70Cb are, for example, parts of circles or ellipses.

In the spinneret 6*b*, spinning holes 5*b* as many as 6,000 or more in total are arranged. In the spinneret 6*b*, the numerous spinning holes 5*b* are classified into two spinning hole groups 71*a* and 71*b*. These spinning hole groups 71*a* and 71*b* form sectional spinning hole regions 72*a* and 72*b*. Between the spinning hole group 71*a* and the spinning hole group 71*b*, there is a spinning hole-free zone 71*ab* free from spinning holes.

The form of the envelope 70*a* drawn by connecting the spinning holes positioned on the outermost side in the array of all the spinning holes 5*b* formed in the spinneret 6*b* is similar to the outer circumferential form 70 of the spinneret 6*b*. The spinning hole region 72 in the spinneret 6*b* is formed by the face surrounded by the envelope 70*a*.

In FIG. 7, the straight line distance A1 referred to in the first definition of the aspect ratio Ra of the spinning hole array in the spinneret 6*b* is indicated by symbol A1, and the straight line distance B1 is indicated by symbol B1. Further, the length A2 of the longest line segment referred to in the second definition of the aspect ratio Ra of the spinning hole array is indicated by symbol A2, and the length B2 of the shortest line segment is indicated by symbol B2. The numerous spinning holes 5*b* in the spinneret 6*b* are arranged to ensure that the aspect ratio of the spinning hole array becomes 2.5 or more.

In the case where the aspect ratio Ra of the spinning hole array in the spinneret 6 having 6,000 or more spinning holes 5 in total is less than 2.5, the distance between the spinneret surface 7 and the liquid surface of a coagulating liquid, namely, air gap in the position of the spinning holes positioned near the outer circumference of the spinneret surface 7 becomes greatly different from that in the position of the spinning holes positioned near the center of the spinneret surface 7. For this reason, the adjacent filaments discharged from the spinning holes 5 are likely to adhere to each other and to be broken directly under the spinneret surface 7.

On the other hand, if the aspect ratio Ra of the spinning hole array is larger, the influence of the liquid surface variation of the coagulating liquid on the filaments directly under the spinneret surface 7 becomes small. However, the coagulating bath becomes large, and it is difficult to increase the holes of the spinneret 6. Further, the handling property of the fiber bundle during spinning becomes worse. So, it is preferred that the aspect ratio Ra is 2.5 to 4.0. Amore preferred range is 3.0 to 3.8.

Figure 9:
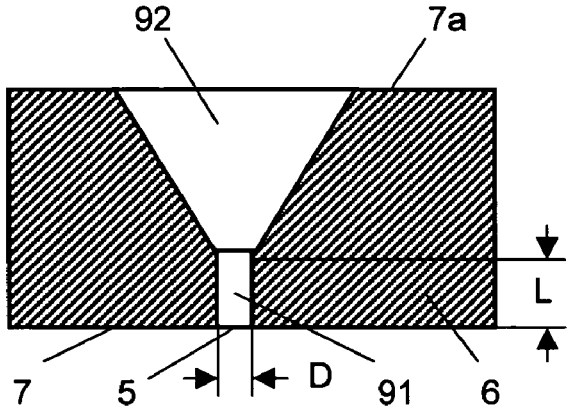
FIG. 9 is a vertical sectional showing an example of a spinning hole formed in the spinneret shown in FIG. 5 or FIG. 7.

FIG. 9 shows an example of a spinning hole 5 formed in the spinneret 6.

In FIG. 9, the spinning hole 5 formed in the spinneret 6 comprises a spinning hole body 91 formed from the spinneret surface 7 inward (upward in the drawing) and a funnel portion 92 formed from the surface 7*a* opposite to the spinneret surface 7 inward (downward in the drawing) and connected with the spinning hole body 91. The spinning hole body 91 has diameter D (hereinafter referred to as the spinning hole diameter D) and length L (hereinafter referred to as the spinning hole length L).

It is preferred that the spinning hole diameter D is 0.08 to 0.18 mm. A more preferred range is 0.10 to 0.15 mm. In the case where the spinning hole diameter D is smaller than 0.08 mm, it may be difficult to wash the spinneret, since the washing liquid is unlikely to flow into the respective spinning holes. On the other hand, in the case where the spinning hole diameter D is larger than 0.18 mm, the raw spinning solution discharged from the respective spinning holes may not go into the coagulating bath straight and may be fused to the regions adjacent to the spinning holes, causing the filaments to be broken.

It is preferred that the ratio L/D of the spinning hole length L to the spinning hole diameter D is 2 to 5. If L/D is less than 2, the raw spinning solution discharged from the respective spinning holes may not go into the coagulating bath straight and may be fused to the regions adjacent to the spinning holes, causing the filaments to be broken. On the other hand, if L/D is more than 5, it may be difficult to wash the spinneret, since the washing liquid is unlikely to flow into the respective spinning holes.

It is preferred that the numerous spinning holes 5 of the spinneret 6 are arranged in such a manner that a distance (spinning hole pitch) between the centers of adjacent spinning holes in the long side direction and in the short side direction of the spinneret 6 is in the range of 1 to 3 mm.

If the spinning hole pitch is smaller than 1 mm; the gas (usually air) is likely to be disturbed in the gas phase portion formed between the spinneret surface 7 and the liquid surface of the coagulating liquid. In this case, the adjacent filaments are likely to adhere to each other. On the other hand, if the spinning hole pitch is larger than 3 mm, the spinneret 6 is enlarged, and the liquid surface of the coagulating liquid is likely to swell in the positions between the respective filaments discharged into the coating bath. A swelling in the liquid surface of the coagulating liquid causes the spinneret surface 7 to be immersed in the coagulating liquid. Therefore, it is more preferable that the spinning hole pitch is in the range of 1.5 to 2.5 mm.

It is preferred that the numerous spinning holes 5 of the spinneret 6 in the spinning pack 1 for semi-wet spinning of the invention are arranged in such a manner that they are classified into plural sectional spinning hole regions. The plural sectional spinning hole regions are shown, for example, as sectional spinning hole regions 52*a*, 52*b* and 52*c* in FIG. 5 and as sectional spinning hole regions 72*a* and 72*b* in FIG. 7.

If plural sectional spinning hole regions are formed, a spinning hole-free zone(s) is formed between adjacent sectional spinning hole regions. The spinning hole-free zone(s), is shown, for example, as the spinning hole-free zone 53*ab* or 53*bc* in FIG. 5 and as the spinning hole-free zone 71*ab* in FIG. 7.

The spinning hole-free zone is formed as a groove provided between the plural sectional spinning hole regions. The spinning hole-free zone is utilized for a place for fixing the spinneret when the spinneret is manufactured. The spinning hole-free zone allows the production of a highly accurate spinneret.

When the discharge of the raw spinning liquid from the respective spinning holes is checked after installing the spinning pack in the raw spinning liquid feed line, the presence of the plural sectional spinning hole regions facilitates the confirmation of the positions (addresses) of the spinning holes to be checked. This allows efficient repair work of the spinneret.

The configuration of the plural sectional spinning hole regions on the spinneret surface can be, for example, four regions located to form a cross shape, plural regions located in parallel to each other merely in one direction, or four regions located in parallel to each other lengthwise and crosswise as if to form a rectangle as a whole. A configuration preferred in view of high speed production of a fiber bundle is the plural parallel regions. The configuration of the plural parallel regions is shown, for example, as the sectional spinning hole regions 52*a*, 52*b* and 52*c* in FIG. 5 and as the sectional spinning hole regions 72*a* and 72*b* in FIG. 7. In the configuration of the plural parallel regions, it can be prevented that flow of the coagulating liquid from the liquid surface region of the coagulating liquid facing the spinning hole-free zone to the liquid surface region of the coagulating liquid facing the sectional spinning hole region collides directly under the spinneret surface. Therefore, this configuration gives a large effect of inhibiting the liquid surface variation of the coagulating liquid.

The number of regions can be decided in response to a form of the spinneret, a fineness of the fibers, etc. For example, if the aspect ratio Ra of the spinning hole array is 2.5, it is desirable that the number of regions is 2, and if the aspect ratio Ra is 3.8, it is desirable that the number of regions is 4.

It is preferred that a width of each spinning hole-free zone is 2.5 mm to 8 mm. If the width of the spinning hole-free zone is less than 2.5 mm, it can happen that the width is equal to the value of hole intervals of respective spinning holes (spinning hole pitch). In this case, it is difficult to manufacture the spinneret or repair the spinneret surface. If the width of each spinning hole-free zone is more than 8 mm, flow of the coagulating liquid from the liquid surface region of the coagulating liquid facing the spinning hole-free zone to the liquid surface region of the coagulating liquid facing the sectional spinning hole region forms vortexes directly under the spinneret surface, and the filaments discharged from the spinning holes are likely to be broken. Otherwise, the spinneret surface is likely to be immersed in the coagulating liquid. It is more preferred that the width of each spinning hole-free zone is 3 mm to 7 mm. A further more preferred range is 4 mm to 6 mm.

It is preferred that a flatness of the spinneret is 0.02 mm or less. The flatness is measured as described below. The spinneret is placed on a surface plate, and a dial gauge is applied to the spinneret surface. The dial gauge refers to a generally used micrometer having a needle. The measurement length per place is 5 mm, and this measurement is performed at eight places selected at random on the spinneret surface. The difference between the maximum value and the minimum value of the obtained measured values is employed as the flatness. In the case of a spinneret in which the aspect ratio Ra of the spinning hole array is 2.5 or more, if the flatness of the spinneret is more than 0.02 mm in the spinning hole region outermost in the longitudinal direction of the spinneret, the air gap difference becomes large locally. So, it is preferred that the flatness is 0.02 mm or less.

The spinning pack 1 for semi-wet spinning of the invention has a spinneret having 6,000 or more spinning holes 5, in which the aspect ratio Ra of the spinning hole array is 2.5 or more. Therefore, a distance from the raw spinning solution feed port 4 to the spinning holes positioned near the short sides of the spinneret 6 is long. For this reason, a difference is likely to occur between the discharge state of the raw spinning solution discharged from the spinning holes positioned near the center of the spinneret surface 7 and the discharge state of the raw spinning solution discharged from the spinning holes positioned near the outer circumference of the spinneret surface 7, especially near the short sides of the spinneret 6.

Figure 3:
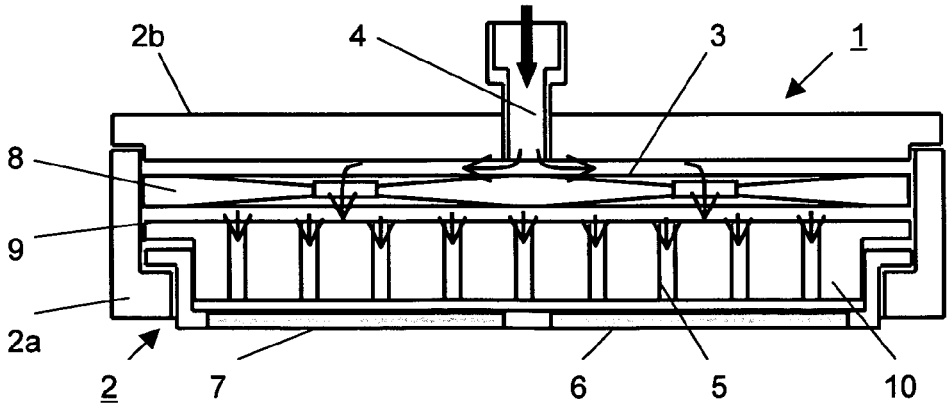
FIG. 3 is an S1-S1 arrow sectional view of FIG. 2.
Figure 4:
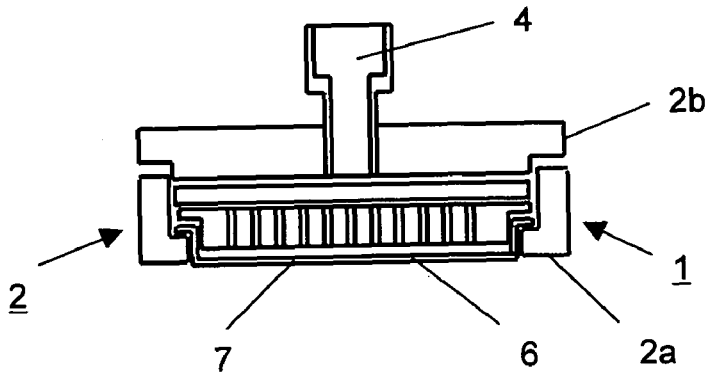
FIG. 4 is an S2-S2 arrow sectional view of FIG. 2.

To keep the difference in the discharge state as small as possible, or to eliminate the difference, it is preferred that a branch plate 8 is installed in the raw spinning solution passage 3 as shown in FIG. 3 in the spinning pack 1 for semi-wet spinning of the invention. Owing to the branch plate 8, the raw spinning solution fed from one raw spinning solution feed port 4 to the raw spinning solution passage 3 is branched into plural streams, being distributed to the spinneret 6. The branch plate 8 also functions to prevent the spinning pack 1 from being strained.

Figure 10:
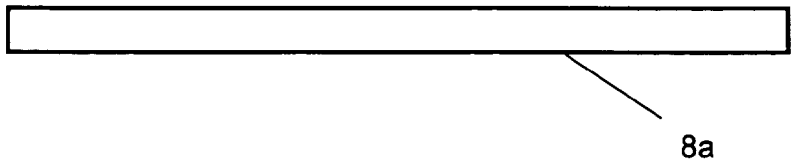
FIG. 10 is a front view showing an example of the branch plate used in the spinning pack of FIG. 1.
Figure 11:
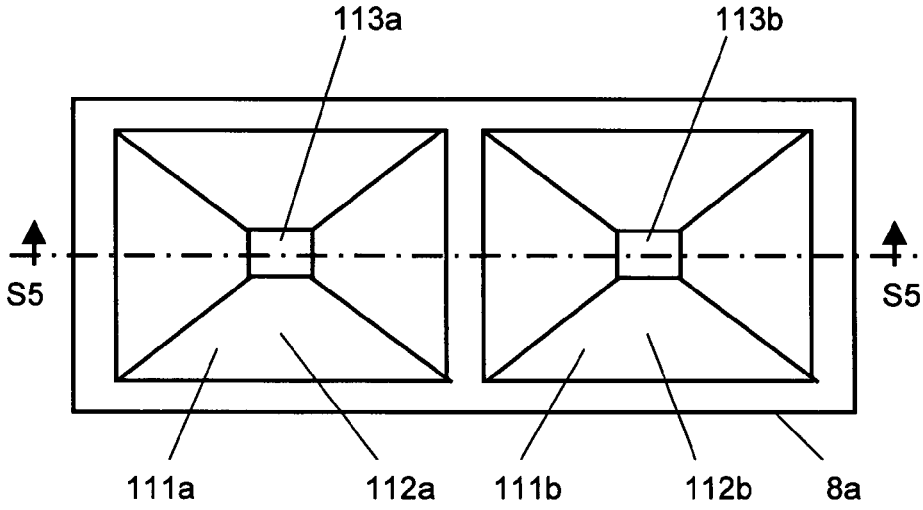
FIG. 11 is a top view showing the branch plate of FIG. 10.
Figure 12:
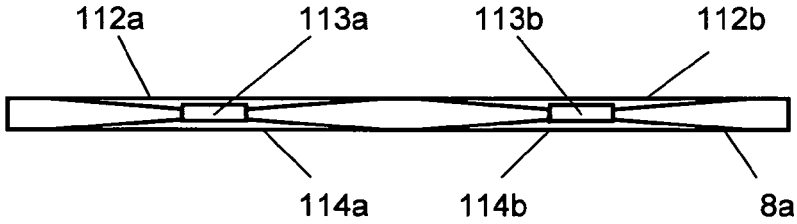
FIG. 12 is an S5-S5 arrow sectional view of FIG. 11.

In FIGS. 10 to 12, an example of the branch plate 8 used in the spinning pack 1 is shown.

In FIGS. 10 to 12, a branch plate 8*a* has two branch passages 111*a* and 111*b*. Each of the branch passages 111*a* and 111*b* comprises an upstream hollow portion 112*a* or 112*b* formed from the circumference of the top face toward the center, a branch hole 113*a* or 113*b* formed in the bottom of the upstream hollow portion 112*a* or 112*b*, and a downstream hollow portion 114*a* or 114*b* formed from the circumference of the bottom face toward the center, respectively. The bottom (top face in the drawing) of the downstream hollow portion 114*a* or 114*b* communicates with the branch hole 113*a* or 113*b* respectively. As required, plural similar branch plates can be installed in stages so that the raw spinning solution can be separated like a tournament chart.

It is more preferred that the raw spinning solution is branched into streams as many as the sectional spinning hole regions of the spinneret 6, and that a branch hole is located upward at the center of each spinning hole region.

In the spinning pack 1 for semi-wet spinning of the invention, it is preferred that a perforated plate 10 is installed in the raw spinning solution passage 3. In general, it is assumed that the raw spinning solution flowing from the raw spinning solution feed port 4 of the spinning pack 1 into the raw spinning solution passage 3 contains any foreign matter, and a filter 9 for filtering away the foreign matter is installed in the raw spinning solution passage 3 before the raw spinning solution reaches the spinning holes 5. It is preferred that the perforated plate 10 for supporting the filter 9 is installed between the spinneret 6 and the branch plate 8.

Figure 13:
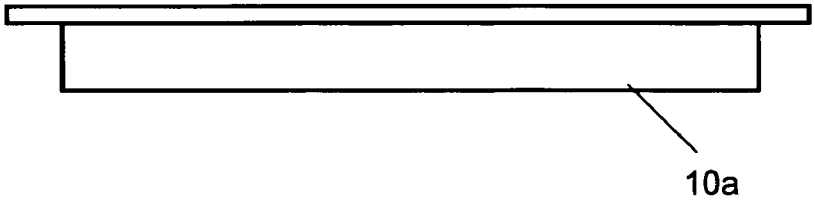
FIG. 13 is a front view showing an example of the perforated plate used in the spinning pack of FIG. 1.
Figure 14:
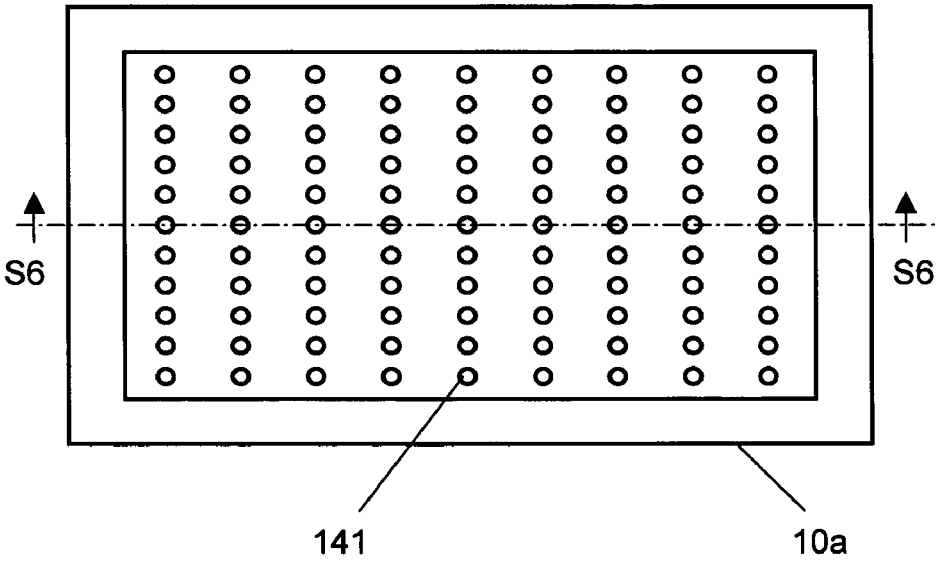
FIG. 14 is a top view showing the perforated plate of FIG. 13.
Figure 15:
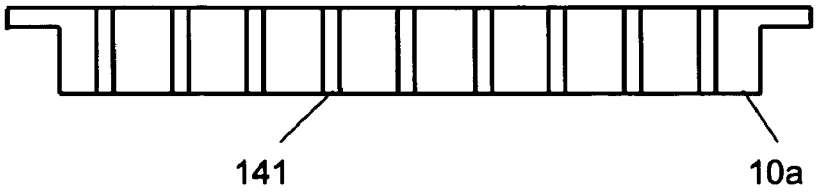
FIG. 15 is an S6-S6 arrow sectional view of FIG. 14.

FIGS. 13, 14 and 15 show an example of the perforated plate 10 used in the spinning pack 1 for semi-wet spinning.

In FIGS. 13 to 15, a perforated plate 10*a* has numerous flow-through holes 141 uniformly formed over the entire surface. The numerous flow-through holes 141 uniformly formed over the entire surface allow the raw spinning solution to uniformly flow over the entire surface of the filter 9 placed on the perforated plate 10*a*, without allowing the raw spinning solution to be retained locally.

It is preferred that the hole density of the flow-through holes 141 in the perforated plate 10*a* is larger than the hole density of the spinning holes in the spinneret 6. It is preferred that the opening percentage of the flow-through holes 141 of the perforated plate 10*a* based on the raw spinning solution passage area on the top face of the perforated plate 10*a* is 15 to 30%.

It is preferred that the gap between the spinneret 6 and the perforated plate 10 in the spinneret housing 2 is 1 to 5 mm. If the gap is less than 1 mm, the raw spinning solution fed from the perforated plate 10 to the spinneret 6 and discharged from the numerous spinning holes 5 is likely to be locally irregular, and the increase of pressure in the spinning pack 1 is likely to deform the spinneret 6. On the other hand, if the gap is more than 5 mm, the raw spinning solution discharged from the spinning holes positioned near the center of the spinneret surface 7 is likely to be different in amount from that discharged from the spinning holes positioned near the outer circumference, and further, the raw spinning solution is likely to be locally retained and deteriorated. A more preferred gap ranges from 1 to 3 mm.

The spinning pack 1 for semi-wet spinning of the invention is combined with a coagulating bath tank installed below it, to be used for producing a fiber bundle. An example of the apparatus for producing fibers of the invention is shown in FIG. 16.

Figure 16:
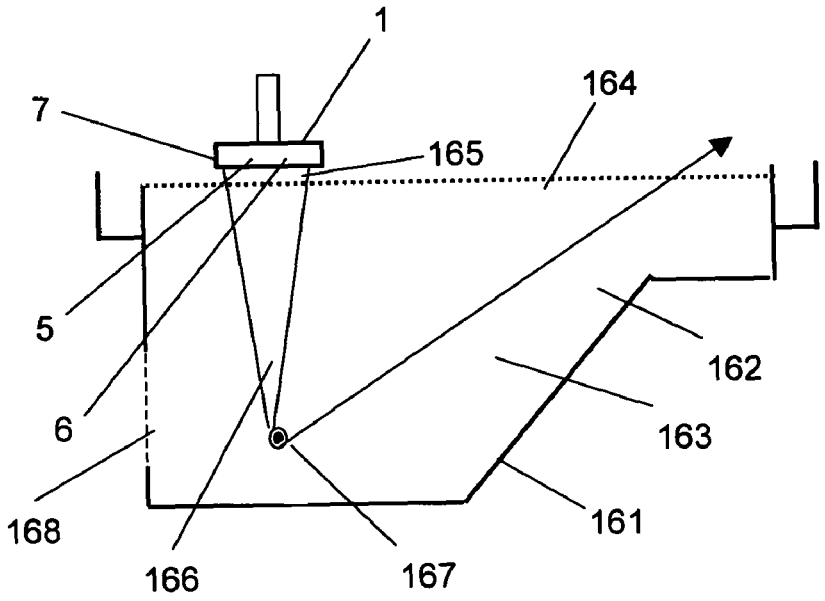
FIG. 16 is a schematic sectional view showing a part of the apparatus for producing fibers of the invention.

In FIG. 16, below the spinning pack 1 for semi-wet spinning, a coagulating bath tank 161 is installed. The coagulating bath tank 161 internally accommodates a coagulating liquid 162, to form a coagulating bath 163. Between the liquid surface 164 of the coagulating liquid 162 and the spinneret surface 7 of the spinneret 6 of the spinning pack 1, a gas phase portion 165 is present. The gas phase portion 165 is usually formed by air.

In the coagulating bath tank 161, installed is a diverting guide 167 for changing the running direction of the fiber bundle 166 comprising the numerous filaments discharged from the numerous spinning holes 5 formed in the spinneret 6. The fiber bundle 166 runs in contact with the diverting guide 167, to be changed in the running direction thereof, and is taken up outside the coagulating bath tank 161.

A tank wall of the coagulating bath tank 161 partially has an observation hole 168 formed so that the running state of the fiber bundle 166 in the coagulating bath 163, especially the possible disturbance in the arrangement of the filaments constituting the fiber bundle 166 on the diverting guide 167 and the possible winding of the filaments around the diverting guide 167 can be observed. The form of the observation hole 168 is, for example, circular or quadrilateral. The observation hole 168 can also be formed in a tank wall as a whole of the coagulating bath tank 161.

The diverting guide 167 is installed and supported by the tank walls of the coagulating bath tank 161 so that the axial direction of the diverting guide (direction perpendicular to the paper surface in FIG. 16) may be parallel to the long side direction of the spinneret 6 corresponding to the width direction of the aspect ratio Ra (direction perpendicular to the paper surface in FIG. 16). In the diverting guide 167 and the spinneret 6, it is preferred that FBW as the width of the fiber bundle 166 on the diverting guide 167 and SLEL as the length of the long sides 6LE of the spinneret satisfy the following relation (see FIG. 18).

$$0.5 \leqq \text{Width of the fiber bundle on the diverting guide (FBW)/Length of the long sides of the spinneret (SLEL)} \leqq 1.0$$

In the case where the value of FBW/SLEL is smaller than 0.5, when the filaments 166SEa and 166SEb discharged from the spinning holes 5SEa and 5SEb on the short sides of the spinneret 6 are bundled into the fiber bundle 166 in the coagulating bath 163, the take-up angle θa becomes small. As a result, the filaments are likely to be broken.

In the case where the value of FBW/SLEL is larger than 1.0, the arrangement of filaments in the fiber bundle is likely to be disturbed. If the arrangement of filaments in the fiber bundle 166 is disturbed, the filaments become loose in the product obtained by winding the fiber bundle 166, to lower the appearance quality of the product. It is more preferred that the value of FBW/SLEL is 0.6 to 0.9.

A width of the fiber bundle 166 on the diverting guide 167 can be adjusted by changing the installation depth of the diverting guide 167 in the coagulating bath 163, or changing the radius of curvature RC of the diverting guide 167 in the longitudinal direction (axial direction), or installing a yarn width regulating element (not shown in the drawing) between the spinneret 6 and the diverting guide 167.

Figure 17:
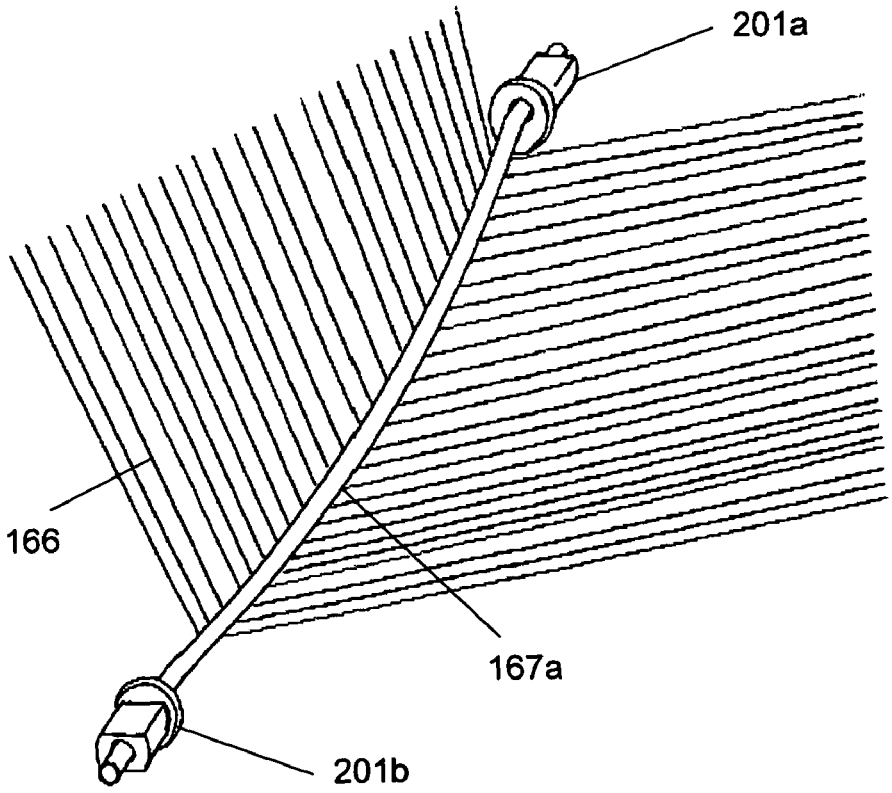
FIG. 17 is a perspective view showing an example of the fiber bundle diverting guide used in the coagulating bath tank of the apparatus for producing fibers of FIG. 16.
Figure 20:
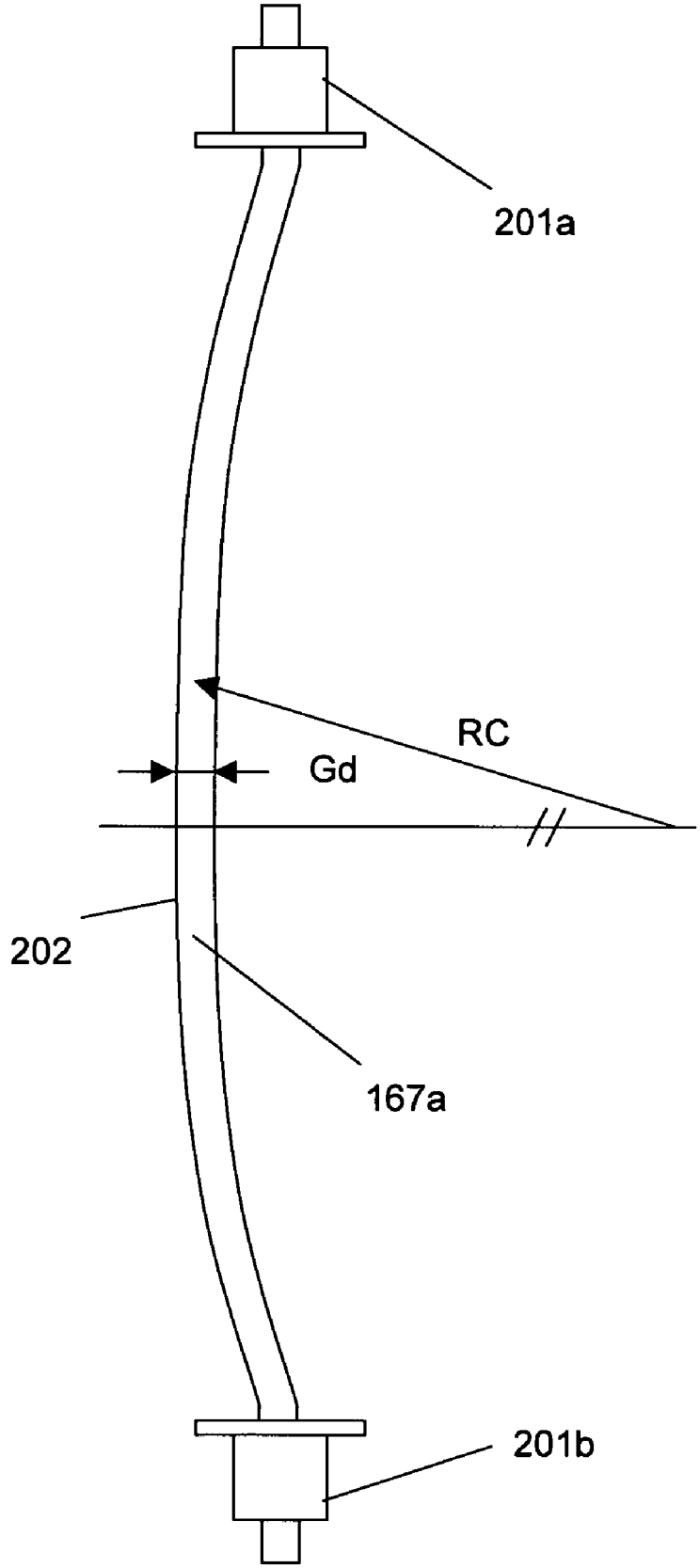
FIG. 20 is a side view showing an example of the diverting guide of the invention.

FIGS. 17 and 20 show an example of the diverting guide 167.

In FIGS. 17 and 20, a diverting guide 167*a* has a curve having a radius of curvature RC of 1,000 to 3,000 mm in the major portion in the longitudinal direction (axial direction) thereof, and is supported by bearings 201*a* and 201*b* at both ends in such a manner that it can rotate around the axis thereof. The bearings 201*a* and 201*b* are installed in the tank walls of the coagulating bath tank 161.

If the radius of curvature RC of the diverting guide 167*a* is less than 1,000 mm, the filaments may adhere to each other in the coagulating bath 163. If the radius of curvature RC is more than 3,000 mm, the effect of bundling the numerous filaments when the fiber bundle 166 is formed may decline, and a tension acting on the filaments in the coagulating bath 163 may become high.

The cross sectional form of the diverting guide 167*a* is adequately selected in relation with the strength depending on the material thereof. Usually it is preferred that the cross sectional form is circular and that a diameter Gd at the minimum cross sectional area portion is 3 to 10 mm.

The diverting guide 167*a* is, for example, a rod made of a hard chromium-plated metal, or a rod made of a metal coated with titanium, alumina, ceramics such as titanium carbide, teflon (registered trademark), silicon, etc. Among these examples, a rod made of hard chromium-plated stainless steel is more preferred.

It is preferred that a surface 202 of the diverting guide 167*a* in contact with the fiber bundle 166 is a satin finished surface. In this case, the contact area with the fiber bundle 166 can be small, to reduce the coefficient of friction, thereby lowering a tension acting on the fiber bundle 166. The surface 202 in contact with the fiber bundle 166 can also be a mirror finished surface, but this is not preferred since the contact area with the fiber bundle 166 increases to raise the coefficient of friction. Especially when the diverting guide 167 is plated with hard chromium, it is preferred that the diverting guide 167 has a satin finished surface.

It is preferred that the average grain size of the satin finished surface is 5 to 50 μm. In this case, the coefficient of friction between the diverting guide 167 and the fiber bundle 166 is optimized, and in addition, the tension acting on the fiber bundle 166 can be adjusted to an adequate value.

The average grain size of the satin finished surface can be measured by observing with an epi-illumination metallographic microscope. On the surface 202 of the diverting guide 167 in the portion in contact with the fiber bundle 166, ten places of measurement are selected at random, and observed and measured using a vertical fluorescence metal microscope. The average value of the obtained values is employed as the average grain size of the satin finished surface.

Since the diverting guide 167*a* has a radius of curvature RC as shown in FIG. 20, it has a gentle curve in the longitudinal direction thereof, and it can rotate around the axis thereof. Therefore, the diverting guide 167*a* supported by the bearings 201*a* and 201*b* freely rotates to contact the fiber bundle 166 at the most suitable position of the curve in response to the take-up tension of the fiber bundle 166, for optimizing the tension.

For example, if the tension is high, the diverting guide 167*a* rotates to ensure that a relatively depressed portion contacts the fiber bundle 166 for lowering the tension. If the tension is low, the diverting guide 167*a* rotates to ensure that a relatively projected portion contacts the fiber bundle 166 for not lowering the tension. Further, the take-up angle of the fiber bundle 166 after completion of diversion (the angle formed between the axis of the diverting guide 167*a* and the fiber bundle 166 after completion of diversion) can also be adjusted and the angle always most suitable for the running direction of the fiber bundle 166 can be achieved.

A method for producing a fiber bundle of the invention is explained below in reference to FIGS. 18 and 19.

The method for producing a fiber bundle by semi-wet spinning of the invention is characterized in that a take-up angle θ of the filaments discharged from the outermost spinning holes formed nearest to the outer circumference of the spinneret 6 and running toward the diverting guide 167, relative to the spinneret surface 7 is 83° to 92°.

If the take-up angle θ is smaller than 83°, a tension acting on the filaments discharged from the spinning holes positioned near the center of the spinneret surface 7 is greatly different from the tension acting on the filaments discharged from the spinning holes positioned near the outer circumference of the spinneret surface 7. An excessive tension acts especially on the filaments 166SEa and 166SEb discharged from the spinning holes 5SEa and 5SEb located on the short sides of the spinneret surface 7. As a result, the filaments are likely to be broken since an excessive tension act on them.

If the take-up angle θ is larger than 92°, the arrangement of filaments is likely to be disturbed since the width of the fiber bundle 166 is widened. The disturbance in the arrangement of filaments refers to a phenomenon that the filaments wobble, and causes variation in the fineness of filaments. The disturbance in the arrangement of filaments loosens the filaments in the fiber bundle package obtained by winding the fiber bundle 166 around a bobbin, etc. A fiber bundle package having loose filaments is evaluated as a product having low appearance quality.

The take-up angle θ of the filaments discharged from the outermost spinning holes formed nearest to the outer circumference of the spinneret 6 and running toward the diverting guide 167, relative to the spinneret surface 7 includes two cases, take-up angle θa and take-up angle θb.

Figure 18:
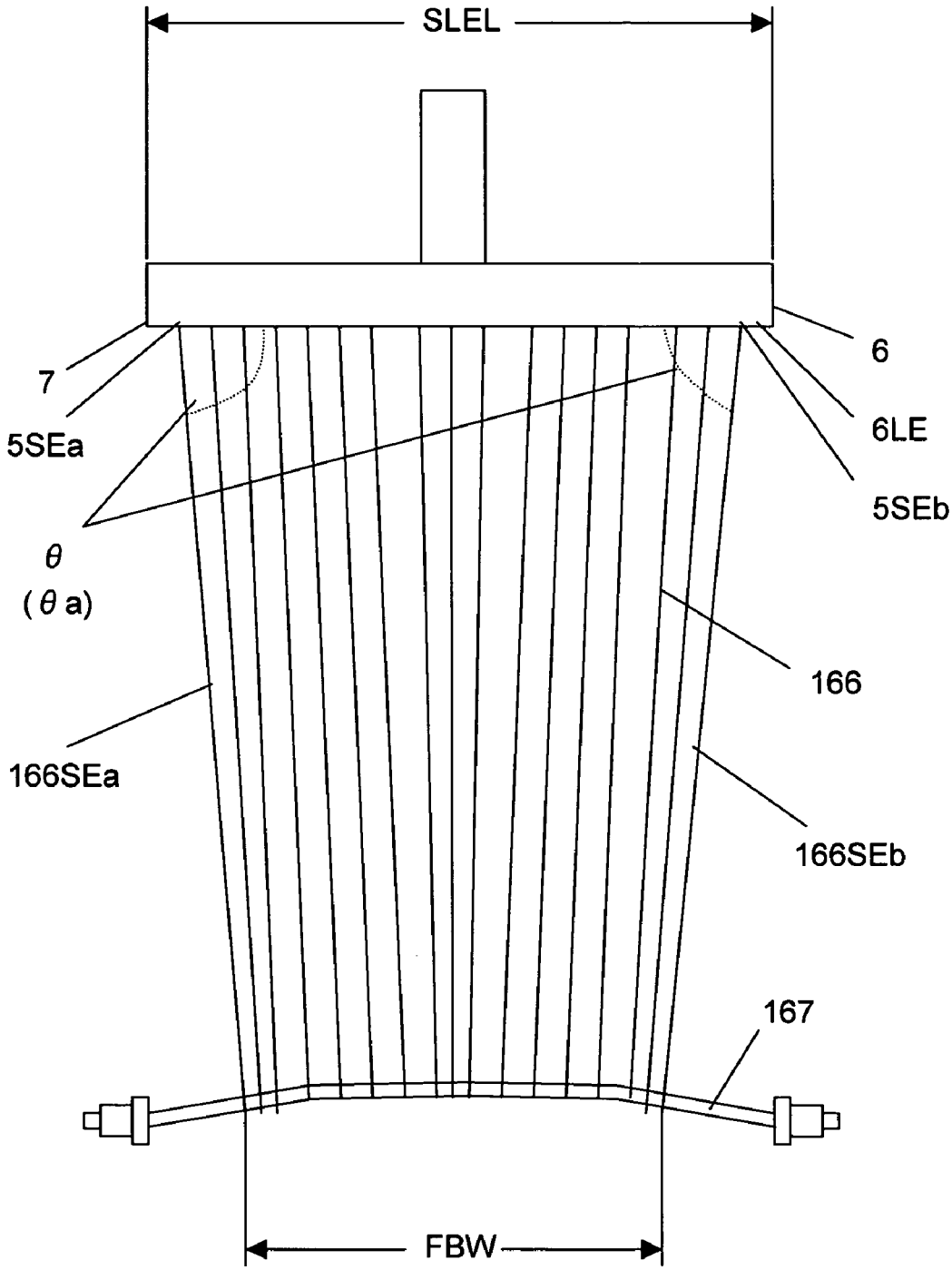
FIG. 18 is a drawing showing an example of the state where a fiber bundle runs from the spinning holes arranged in the long side direction of the spinneret toward the diverting guide in the apparatus for producing fibers of FIG. 16.

FIG. 18 shows an example of the take-up angle θa as one case of the take-up angle θ. In FIG. 18, the angle of the filaments 166SEa and 166SEb discharged from the spinning holes 5SEa and 5SEb positioned at the outermost positions on both sides in the long side 6LE direction of the spinneret 6, i.e., the outermost spinning holes 5SEa and 5SEb of the short sides 6SE of the spinneret 6 and running toward the diverting guide 167, relative to the spinneret surface 7 is the take-up angle θa. In the method for producing a fiber bundle of the invention, it is preferred that the take-up angle θa is 87° to 92°. Amore preferred take-up angle θa range is 89° to 91°.

Figure 19:
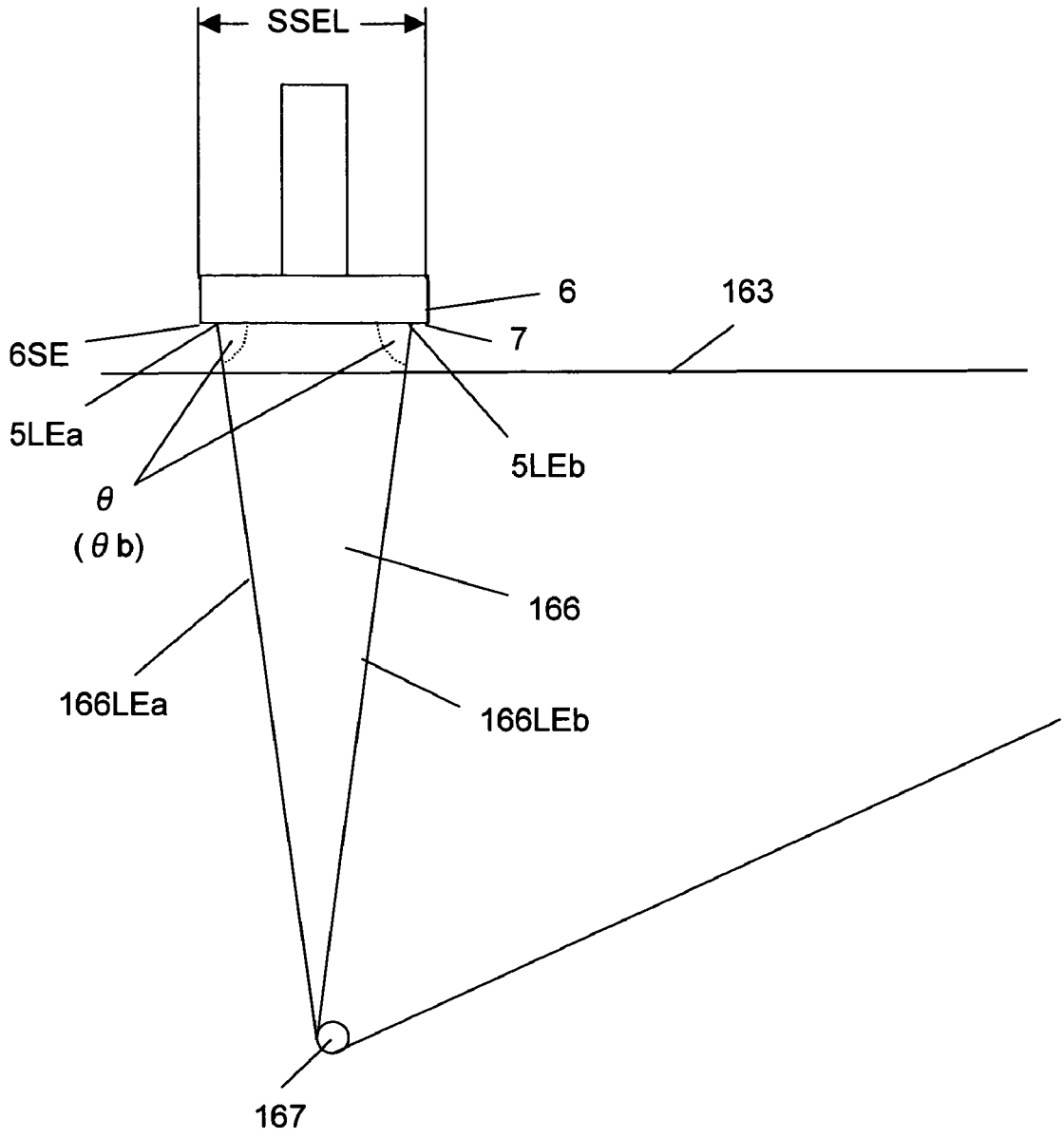
FIG. 19 is a drawing showing an example of the state where a fiber bundle runs from the spinning holes arranged in the short side direction of the spinneret toward the diverting guide in the apparatus for producing fibers of FIG. 16.

FIG. 19 shows an example of a take-up angle θb as the other case of the take-up angle θ. In FIG. 19, the angle of the filaments 166LEa and 166LEb discharged from the spinning holes 5LEa and 5LEb positioned at the outermost positions on both sides in the short side 6SE direction of the spinneret 6, i.e., the outermost spinning holes 5LEa and 5LEb of the long sides 6LE of the spinneret 6, relative to the spinneret surface 7 is the take-up angle θb. In the method for producing a fiber bundle of the invention, it is preferred that the take-up angle θb is 83° to 87°. A more preferred take-up angle θb range is 85° to 87°.

The take-up angles θ, θa and θb can be calculated by calculation from the relation among the positions of the filaments running at the extreme ends on the diverting guide 167, the positions of the outermost spinning holes of the spinneret 6, and the distance from the spinneret surface 7 to the diverting guide 167. Further, a protractor can also be applied to the spinneret surface 7, to directly measure the angle of filaments.

The take-up angle θ of the fiber bundle 166 can be optimized by adjusting the distance between the spinneret surface 7 and the diverting guide 167 and the width FBW of the fiber bundle 166 on the diverting guide 167. The width FBW of the fiber bundle 166 on the diverting guide 167 can be adjusted by changing the radius of curvature RC of the diverting guide 167 in the longitudinal direction thereof, or installing a yarn width regulating element (not shown in the drawing) between the spinneret 6 and the diverting guide 167. Further, if the aspect ratio Ra of the spinning hole array is adjusted, the take-up angle θ of the filaments discharged from the outermost spinning holes 5LEa and 5LEb of the long sides 6LE of the spinneret 6 can be adjusted.

The diverting guide 167 for changing the running direction of the fiber bundle 166 can remarkably decreases the area of the accompanying flow generated by the spread of the fiber bundle 166 in the coagulating liquid 162 of the coagulating bath 163. As a result, it can be prevented that the tension acting on the fiber bundle 166 after completion of diversion is extremely increased, and the filaments of the fiber bundle 166 can be prevented from being broken.

As the raw material of the fibers used in the method for producing a fiber bundle of the invention, an acrylic polymer can be preferably used. It is preferred that the acrylic polymer used is produced from 90 wt % or more of acrylonitrile and less than 10 wt % of a monomer copolymerizable with acrylonitrile.

A copolymerizable monomer can be at least one selected from a group consisting of acrylic acid, methacrylic acid, itaconic acid, their methyl esters, propyl esters, butyl esters, alkali metal salts, ammonium salts, allylsulfonic acid, methallylsulfonic acid, styrenesulfonic acid, and their alkali metal salts.

Such an acrylic polymer can be obtained by such a polymerization method as emulsion polymerization, block polymerization or solution polymerization. As the yardstick for the polymerization degree in this case, an intrinsic viscosity of 1.0 or more is preferred. More preferred is 1.25 or more, and especially preferred is 1.5 or more. It is preferred in view of spinning stability that the intrinsic viscosity is 5.0 or less.

From the obtained polymer, a polymer solution is prepared using dimethylacetamide, dimethyl sulfoxide (hereinafter referred to as DMSO), dimethylformamide, nitric acid or sodium rhodanate washing liquid, etc. as the solvent. The polymer solution is used as a raw spinning solution in the method for producing a fiber bundle of the invention.

In the case of a spinning method using a solvent and a plasticizer, s spun fiber bundle can be stretched in a bath directly or after washing away a solvent and a plasticizer. It is preferred that a stretching ratio in the stretching in a bath is about 2 to about 6 times in a bath of 30 to 98° C. After completion of stretching in a bath, it is preferred to apply a silicone oil to the fiber bundles. The silicone oil is often used as an emulsion, and in this case, it is preferred to use an emulsifier together.

The emulsifier refers to a compound having surface activity that promotes and stabilizes the production of the emulsion. As a particular example, a polyethylene glycol alkyl ether can be preferably used.

A method for applying the silicone oil to the fiber bundle can be adequately selected. Particularly such a means as immersion, use of kiss roller or guide lubrication can be employed. It is preferred that the deposited amount of the silicone oil is 0.01 to 8 wt %. A more preferred range is 0.02 to 5 wt %, and an especially preferred range is 0.1 to 3 wt %.

If a deposited amount is smaller than 0.01 wt %, the filaments are likely to fuse each other, to lower the appearance quality of the fiber bundle. If the deposited amount is larger than 8 wt %, the amount of the oil coming off in the fiber bundle production process or in the fiber bundle burning step for producing carbon fibers using the produced fiber bundle becomes large. In this case, marks of the oil deposited in the fiber bundle production process may lower the appearance quality of the fiber bundle or the operation efficiency in the burning step may decline.

The oil-deposited fiber bundle can be quickly dried by at least one or more hot drums, for densifying. It is preferred that the drying temperature is higher, since the crosslinking reaction of the silicone oil is promoted. A drying temperature of 150° C. or higher is preferred, and 180° C. or higher is more preferred.

The drying temperature, drying time, etc. can be adequately changed. Moreover, the dried and densified fiber bundle can also be further stretched as required while being heat-treated in a high temperature environment of pressure steam, etc. The heat treatment uniformly spreads the oil, giving a large effect of preventing the surface defects of filaments caused by adhesion between filaments, and a fiber bundle having a more preferred fineness and crystal orientation degree can be obtained. The steam pressure, temperature, stretching ratio, etc. during the post-stretching can be adequately selected in such a manner that neither filament breaking nor fluff occurs.

The invention is explained further below in reference to examples. The average grain size of the satin finished surface of the diverting guide and the take-up angle of filaments discharged from the outermost spinning holes of the spinneret surface and running toward the diverting guide were respectively obtained according to the measuring methods described before.

EXAMPLE 1

A solution obtained by dissolving 20 wt % of an acrylic polymer having an intrinsic viscosity [η] of 1.75 obtained from 99 mol % of acrylonitrile and 1 mol % of itaconic acid, into dimethyl sulfoxide (hereinafter abbreviated as DMSO) was solution-polymerized to obtain a polymer solution.

Ammonia gas was blown into the obtained polymer solution till the pH became 8.5, to neutralize itaconic acid and to introduce ammonium groups into the polymer, for enhancing the hydrophilicity of the polymer solution, to thereby obtain a raw spinning solution. The temperature of the obtained raw spinning solution was 30° C.

A spinneret 6 having two sectional spinning hole regions each having 3,000 spinning holes 5, i.e., having 6,000 spinning holes in total was prepared. The width of the spinning hole-free zone between the two sectional spinning hole regions was 4 mm. The aspect ratio Ra of the spinning hole array was 3.2. The intervals of the adjacent spinning holes (spinning hole pitch) were 2.5 mm.

The spinning hole diameter D of the respective spinning holes 5 was 0.15 mm, and the spinning hole length L was 0.45 mm. A perforated plate 10 and a branch plate 8 were prepared. The spinneret 6, the perforated plate 10 and the branch plate 8 were assembled into the spinneret housing 2, and the gap between the spinneret 6 and the perforated plate 10 was set at 4 mm, to prepare a spinning pack 1.

Below the spinning pack 1, a coagulating bath tank 161 was arranged. In the coagulating bath tank 161, a stainless steel diverting guide 167 having a hard chromium plated and satin finished surface 202 having an average grain size of 15 μm, a cross sectional area diameter Gd of 5 mm and a radius of curvature RC of 1,500 mm in the longitudinal direction was installed. The diverting guide 167 was installed in the tank walls of the coagulating bath tank 161 in such a manner that it can rotate around the axis thereof.

Into the coagulating bath tank 161, a coagulating liquid 162 consisting of 35 wt % of DMSO and 65 wt % of water was supplied. The temperature of the coagulating liquid 162 was 5° C. The gap between the liquid surface of the coagulating liquid 162 and the spinneret surface 7 was about 3 mm, and a gas phase portion 164 composed of air was present there.

The raw spinning solution prepared as described above was fed from the raw spinning solution feed port 4 of the spinning pack 1 and discharged from the numerous spinning holes 5 of the spinneret 6. Flow of the raw spinning solution consisting of numerous lines discharged and formed by the spinning holes 5 passed through the gas phase portion 165 and went into the coagulating liquid 162, to form a fiber bundle 166 consisting of numerous filaments. The formed fiber bundle was changed in running direction by the diverting guide 167 and taken up at a take-up speed of 25 m/min toward outside the coagulating bath tank 161.

When the fiber bundle was taken up, the take-up angle θb of the filaments from the outermost spinning holes of the long sides 6LE of the spinneret 6 was 87°, and the take-up angle θa of the filaments from the outermost spinning holes of the short sides 6SE of the spinneret 6 was 90°.

The running fiber bundle taken out of the coagulating bath tank 161 was in succession washed with water and stretched to 3 times in hot water having a temperature of 70° C., further being passed through an oil bath, to have a silicone oil deposited on it.

The silicone oil was an aqueous emulsion containing an amino-modified silicone, an epoxy-modified silicone and an alkylene oxide-modified silicone. The oil bath was diluted by water to ensure that the pure oil content (silicone ingredients) became 2.0 wt %.

The fiber bundle treated with the oil was further made to run in contact with a heating roller having a temperature of 180° C., to be dried for a contact time of 40 seconds. The obtained dried fiber bundle was stretched to a stretching ratio of about 5 times in pressure steam of 0.4 MPa-G. The total stretching ratio of the fiber bundle in the entire process was about 13 times.

Then, two fiber bundles, each obtained as described above, were joined to obtain a fiber bundle consisting of 12,000 filaments. The fiber bundle had a filament fineness of 1.1 dtex, a strength of 6.4 g/dtex and an elongation of 7.3%. The deposited amount of the pure silicone oil of the fiber bundle was 1.0 wt %. The fiber bundle had sufficient properties as an acrylic precursor fiber bundle for production of carbon fibers.

EXAMPLE 2

A fiber bundle 166 was produced using the same apparatus and method as those of Example 1, except that the total number of spinning holes 5 was changed to 8,000, that the amount of the raw spinning solution discharged from the spinning holes 5 was changed to 1.67 times, that the take-up angle θb of the single fibers from the outermost spinning holes of the long sides 6LE of the spinneret 6 was changed to 86°, and that the take-up angle θa of the single fibers from the outermost spinning holes of the short sides 6SE of the spinneret 6 was 89°.

The obtained fiber bundle consisted of 16,000 filaments, and had a strength of 6.0 g/dtex and an elongation of 7.1%. The fiber bundle had sufficient properties as an acrylic precursor fiber bundle for production of carbon fibers.

COMPARATIVE EXAMPLE 1

A fiber bundle 166 was produced using the same apparatus and method as those of Example 1, except that the distance between the spinneret 6 and the diverting guide 167 was made shorter.

It was attempted to obtain a fiber bundle consisting of 6,000 filaments having a filament fineness of 1.1 dtex, but since the filaments formed from the outermost spinning holes of the spinneret 6 were often broken, stable production of the fiber bundle could not be continued. In this case, the take-up angle θb of the filaments from the outermost spinning holes of the long sides 6LE of the spinneret 6 was 79°, and the take-up angle θa of the filaments from the outermost spinning holes of the short sides 6SE of the spinneret 6 was 82°.

EXAMPLE 3

A fiber bundle 166 was produced using the same apparatus and method as those of Example 1, except that the average grain size of the satin finished surface of the diverting guide 167 was changed to 35 μm, that the radius of curvature RC in the longitudinal direction was changed to 2,500 mm, and that the take-up angle θa of the filaments from the outermost spinning holes of the short sides 6SE of the spinneret 6 was changed to 92°.

The obtained fiber bundle consisted of 12,000 filaments, and had a strength of 5.9 g/dtex and an elongation of 6.8%. The fiber bundle had sufficient properties as an acrylic precursor fiber bundle for production of carbon fibers.

COMPARATIVE EXAMPLE 2

A fiber bundle 166 was produced using the same apparatus and method as those of Example 1, except that the average grain size of the satin finished surface of the diverting guide 167 was changed to 0 μm, i.e., a mirror finished surface, that the radius of curvature RC in the longitudinal direction was changed to 3,300 mm, and that the take-up angle θa of the filaments from the outermost spinning holes of the short sides 6SE of the spinneret 6 was changed to 93°.

In the production of the fiber bundle, the arrangement of filaments was disturbed in a process range before and after the diverting guide 167. The obtained fiber bundle was irregular in the arrangement of filaments and poor in appearance quality.

COMPARATIVE EXAMPLE 3

A fiber bundle 166 was produced using the same apparatus and method as those of Example 1, except that the average grain size of the satin finished surface of the diverting guide 167 was changed to 35 μm, that the radius of curvature RC in the longitudinal direction was changed to 900 mm, that the take-up angle θb of the filaments from the outermost spinning holes of the long sides 6LE of the spinneret 6 was changed to 85°, and that the take-up angle θa of the filaments from the outermost spinning holes of the short sides 6SE of the spinneret 6 was changed to 89°.

Since the radius of curvature RC of the diverting guide 167 in the longitudinal direction was too small, numerous filaments of the fiber bundle were too densely gathered, and in the obtained fiber bundle, many filaments adhered to each other. The fiber bundle had the filaments broken in the stretching step, to lower the operation efficiency of the stretching step.

COMPARATIVE EXAMPLE 4

A fiber bundle 166 was produced using the same apparatus and method as those of Example 1, except that the average grain size of the satin finished surface of the diverting guide 167 was changed to 35 μm, the radius of curvature RC in the longitudinal direction was changed to 3,300 mm, and that the take-up angle θa of the filaments from the outermost spinning holes of the short sides 6SE of the spinneret 6 was changed to 92°.

In the production of the fiber bundle, the arrangement of filaments was disturbed in a process range before and after the diverting guide 167. The obtained fiber bundle was irregular in the arrangement of filaments and poor in appearance quality.

EXAMPLE 4

A fiber bundle 166 was produced using the same apparatus and method as those of Example 1, except that the average grain size of the satin finished surface of the diverting guide 167 was changed to 60 μm, and that the radius of curvature RC in the longitudinal direction was changed to 1,200 mm.

As in the case of Example 1, a fiber bundle consisting of 12,000 filaments could be stably produced. The obtained fiber bundle had a strength of 5.1 g/dtex and an elongation of 5.9%.

COMPARATIVE EXAMPLE 5

A fiber bundle 166 was produced using the same apparatus and method as those of Example 1, except that the average grain size of the satin finished surface of the diverting guide 167 was changed to 35 μm, and that the diverting guide 167 was fastened not to rotate around the axis thereof.

In the production of the fiber bundle, the take-up tension of the fiber bundle was unstable. As a result, the filaments of the obtained fiber bundle were irregular in fineness in the longitudinal direction thereof, and the fiber bundle was low in appearance quality.

INDUSTRIAL APPLICABILITY

The invention for semi-wet spinning using a spinneret having 6,000 or more spinning holes allows the production of a fiber bundle in which since the respective filaments constituting the spun fiber bundle are unlikely to be affected by the coagulating liquid flow accompanying the fiber bundle running in the coagulating bath, there is little or virtually no fineness irregularity between the filaments formed from the spinning holes positioned near the center of the spinneret surface and the filaments formed from the spinning holes positioned near the outer circumference of the spinneret surface. The produced fiber bundle had few or virtually no filaments broken therein.

Such a fiber bundle can be preferably used as precursor fibers for production of carbon fibers, and the carbon fiber bundle produced by using the fiber bundle contributes to the reduction of the production cost of the carbon fiber bundle having a large fineness, since the number of carbon filaments is large.

The invention claimed is:

1. A spinning pack for semi-wet spinning, comprising a spinneret housing, a raw spinning solution passage formed inside the spinneret housing, a raw spinning solution feed port formed in the spinneret housing, for feeding the raw spinning solution into the raw spinning solution passage, and a spinneret installed in the spinneret housing and having numerous spinning holes arranged at intervals for discharging the raw spinning solution of the raw spinning solution passage, wherein the outer surface of the spinneret faces the liquid surface of a coagulating liquid through a gas phase, and wherein the number of the spinning holes is 6,000 or more and the aspect ratio Ra of an array of the spinning holes is 2.5 or more, wherein the aspect ratio Ra is defined with the formula Ra=A2/B2, where B2 is a length of a shortest line segment among line segments obtained when straight lines passing a center of a spinneret surface cross the spinning hole region and A2 is a length of a longest line segment among line segments obtained when straight lines perpendicular to the shortest line segment cross the spinning hole region, and wherein the spinning hole region is a face surrounded by an envelope drawn by connecting the spinning holes located on the outermost side of the spinning hole array among the numerous spinning holes arranged in the spinneret surface, wherein the numerous spinning holes are classified into at least two spinning hole groups on a surface of the spinneret, and a spinning hole-free zone free from spinning holes is provided between the spinning hole groups, wherein the width of the spinning hole-free zone is the shortest distance between spinning holes of adjacent spinning hole groups and is greater than the distance between adjacent spinning holes in the spinning hole groups.

2. The spinning pack for semi-wet spinning, according to claim 1, wherein the interval between adjacent spinning holes is 1 to 3 mm.

3. The spinning pack for semi-wet spinning, according to claim 1, wherein a branch plate for branching flow of the raw spinning solution is installed in the raw spinning solution passage in the spinneret housing.

4. The spinning pack for semi-wet spinning, according to claim 1, wherein a perforated plate for dispersing flow of the raw spinning solution is installed in the raw spinning solution feed passage in the spinneret housing, and the gap between the perforated plate and the spinneret is 1 to 5 mm.

5. The spinning pack for semi-wet spinning, according to claim 1, wherein the width of the spinning hole-free zone is 2.5 to 8 mm.

6. The spinning pack for semi-wet spinning, according to claim 1, wherein the flatness of a surface of the spinneret is 0.02 mm or less.

7. An apparatus for producing a fiber bundle, comprising a spinning pack for semi-wet spinning, a coagulating bath tank positioned below the spinning pack with a gap formed between them, and a diverting guide installed in the coagulating bath tank, for changing the running direction of the fiber bundle immersed and running in a coagulating liquid accommodated in the coagulating bath tank, wherein the spinning pack for semi-wet spinning is a spinning pack for semi-wet spinning as set forth in claim 1.

8. The apparatus for producing a fiber bundle, according to claim 7, wherein the long side direction of the spinneret corresponding to the width direction of the aspect ratio Ra is parallel to the axial direction of the diverting guide, and the following relation is satisfied:

$$0.5 \leqq \text{Width of the fiber bundle on the diverting guide} / \text{Length of the long sides of the spinneret} \leqq 1.0.$$

9. The apparatus for producing a fiber bundle, according to claim 7, wherein the diverting guide has a curve having a radius of curvature of 1,000 to 3,000 mm in the major portion in the longitudinal direction thereof, and is rotatably supported in the coagulating bath tank.

10. The apparatus for producing a fiber bundle, according to claim 9, wherein a surface of the diverting guide is a satin finished surface having a grain size of 5 to 50 μm.

11. The apparatus for producing a fiber bundle, according to claim 7, wherein an observation hole is provided in the coagulating bath tank, for allowing observation of the inside of the tank from outside the tank.

12. The apparatus for producing a fiber bundle, according to claim 7, wherein the fiber bundle is a precursor fiber bundle used for producing carbon fibers.

13. A method for producing a fiber bundle, in which a fiber bundle is produced using an apparatus for producing a fiber bundle, composed of a spinning pack for semi-wet spinning, a coagulating bath tank positioned below the spinning pack with a gap formed between them, and a diverting guide installed in the coagulating bath tank, for changing the running direction of the fiber bundle immersed and running in a coagulating liquid accommodated in the coagulating bath tank, wherein the spinning pack for semi-wet spinning is a spinning pack for semi-wet spinning as set forth in claim 1, and the take-up angle of the fibers discharged from the outermost spinning holes formed nearest to the outer circumference of the spinneret and running toward the diverting guide, relative to the spinneret surface of the spinneret is 83° to 92°.

14. The method for producing a fiber bundle, according to claim 13, wherein the take-up angle of the fibers discharged from the outermost spinning holes in the long side direction of the spinneret corresponding to the width direction of the aspect ratio Ra and running toward the diverting guide, relative to the spinneret surface of the spinneret is 87° to 92°, and the take-up angle of the fibers discharged from the outermost spinning holes in the short side direction of the spinneret corresponding to the length direction of the aspect ratio Ra and running toward the diverting guide, relative to the spinneret surface of the spinneret is 83° to 87°.

15. The method for producing a fiber bundle, according to claim 13, wherein the diverting guide has a curve having a radius of curvature of 1,000 to 3,000 mm in the major portion in the longitudinal direction thereof, and is rotatably supported in the coagulating bath tank.

16. The method for producing a fiber bundle, according to claim 15, wherein a surface of the diverting guide is a satin finished surface having a grain size of 5 to 50 μm.

17. The method for producing a fiber bundle, according to claim 13, wherein the long side direction of the spinneret corresponding to the width direction of the aspect ratio Ra is parallel to the axial direction of the diverting guide, and the following relation is satisfied:

$$0.5 \leqq \text{Width of the fiber bundle on the diverting guide} / \text{Length of the long sides of the spinneret} \leqq 1.0.$$

18. The method for producing a fiber bundle, according to claim 13, wherein an observation hole is provided in the coagulating bath tank, for allowing observation of the inside of the tank from outside the tank.

19. The method for producing a fiber bundle, according to claim 13, wherein the fiber bundle is a precursor fiber bundle used for producing carbon fibers.

* * * * *